US011140952B2

(12) United States Patent
Oganesian

(10) Patent No.: US 11,140,952 B2
(45) Date of Patent: Oct. 12, 2021

(54) CLASP ASSEMBLY

(71) Applicant: Rafik Oganesian, Glendale, CA (US)

(72) Inventor: Rafik Oganesian, Glendale, CA (US)

( * ) Notice: Subject to any disclaimer, the term of this patent is extended or adjusted under 35 U.S.C. 154(b) by 94 days.

(21) Appl. No.: 16/696,676

(22) Filed: Nov. 26, 2019

(65) Prior Publication Data

US 2021/0153611 A1 May 27, 2021

(51) Int. Cl.
*A44C 5/20* (2006.01)

(52) U.S. Cl.
CPC ..... *A44C 5/2033* (2013.01)

(58) Field of Classification Search
CPC ..... A44C 5/2033; A44C 5/2042
See application file for complete search history.

(56) References Cited

U.S. PATENT DOCUMENTS 1,441,999 A * 1/1923 Posner ..... A44C 5/2042 24/616
1,578,940 A * 3/1926 Wacha ..... A44C 5/209 24/116 A
1,776,892 A * 9/1930 Domler ..... A44C 5/2042 24/647
1,807,293 A * 5/1931 Keller ..... A44C 5/2042 24/616
2,205,092 A * 6/1940 Haeffner ..... A44B 11/28 24/601.5
2,629,156 A 2/1953 Kamens
3,404,440 A * 10/1968 Weiss ..... A44C 5/2042 24/601.5
3,570,078 A 3/1971 Neuman
4,001,923 A 1/1977 Frankel
4,425,687 A 1/1984 Sauer
4,958,420 A 9/1990 Bunz
5,459,909 A 10/1995 Nussberger
5,774,957 A 7/1998 Kohl
6,058,576 A 5/2000 Harris
6,484,376 B1 11/2002 Khatchadourian
7,966,704 B2 6/2011 Yurman
8,756,773 B2 * 6/2014 Kienzle ..... A44C 5/2042 24/574.1
2003/0066171 A1 * 4/2003 Terzian ..... A44C 5/2061 24/647

FOREIGN PATENT DOCUMENTS

EP 1875825 6/2007

* cited by examiner

*Primary Examiner* — Robert Sandy
*Assistant Examiner* — Louis A Mercado

(57) ABSTRACT

A clasp assembly for removably securing two ends of a piece of jewelry includes a first mating segment. The first mating segment includes a key body. The key body is attached to and extends away from the first mating segment. A second mating segment is releasably engaged with the first mating segment. The second mating segment includes a receiver body. The receiver body has a key notch sized to receive the key body. A tab is attached to and extends away from the second mating segment and is configured to engage the key body. A locking clasp is pivotally coupled to the second mating segment. The locking clasp moves between a locked position and an unlocked position. A detent is attached to the locking clasp and is positioned to extend through the second locking aperture to inhibit the key body from being removed from the receiver body.

18 Claims, 7 Drawing Sheets

CLASP ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to jewelry connection devices and more particularly pertains to a new jewelry connection device for removably securing two ends of a piece of jewelry, or chain component thereof for example. Two ends of a piece of jewelry are connected using interlocking features further secured and covered by a cover. To secure the connection a cover to the clasp is engaged to further secure and limit access to the interlocking connections within.

(2) Description of Related Art Including Information Disclosed Under 37 CFR 1.97 and 1.98

The prior art relates to chain connection devices. The disclosures cover a variety of connection methods but are silent on a hinged cover to both further engage with the mechanical locking features within the clasp and prevent accidental disengagement of the ends.

BRIEF SUMMARY OF THE INVENTION

An embodiment of the disclosure meets the needs presented above by generally comprising a first mating segment. The first mating segment includes a first wall. The first wall has an interior surface and an exterior surface. A key body is attached to and extends away from the interior surface. The key body includes a top face and a bottom face. The key body has a first locking aperture therein extending through said top and bottom faces. The key body has a second locking aperture therein extending through said top and said bottom faces. A second mating segment is releasably engaged with the first mating segment. The second mating segment includes a second wall. The second wall has an inner surface and an outer surface. A receiver body is attached to and extends away from the inner surface. The receiver body has a top side. The top side has a key notch extending downwardly therein and sized to receive the key body. A tab is attached to and extends away from the inner surface and is configured to engage with the first locking aperture of the key body when the key body is placed in the key notch. A locking clasp is pivotally coupled to the second mating segment. The locking clasp is movable between a locked position and an unlocked position. The locked position includes the locking clasp extending over and releasably engaging the key body to retain the key body in the receiver body. The locking clasp includes a panel. The panel has a mating surface. A detent is attached to the mating surface and is positioned to extend through the second locking aperture when the mating surface faces the top face to inhibit the key body from is removed from the receiver body.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
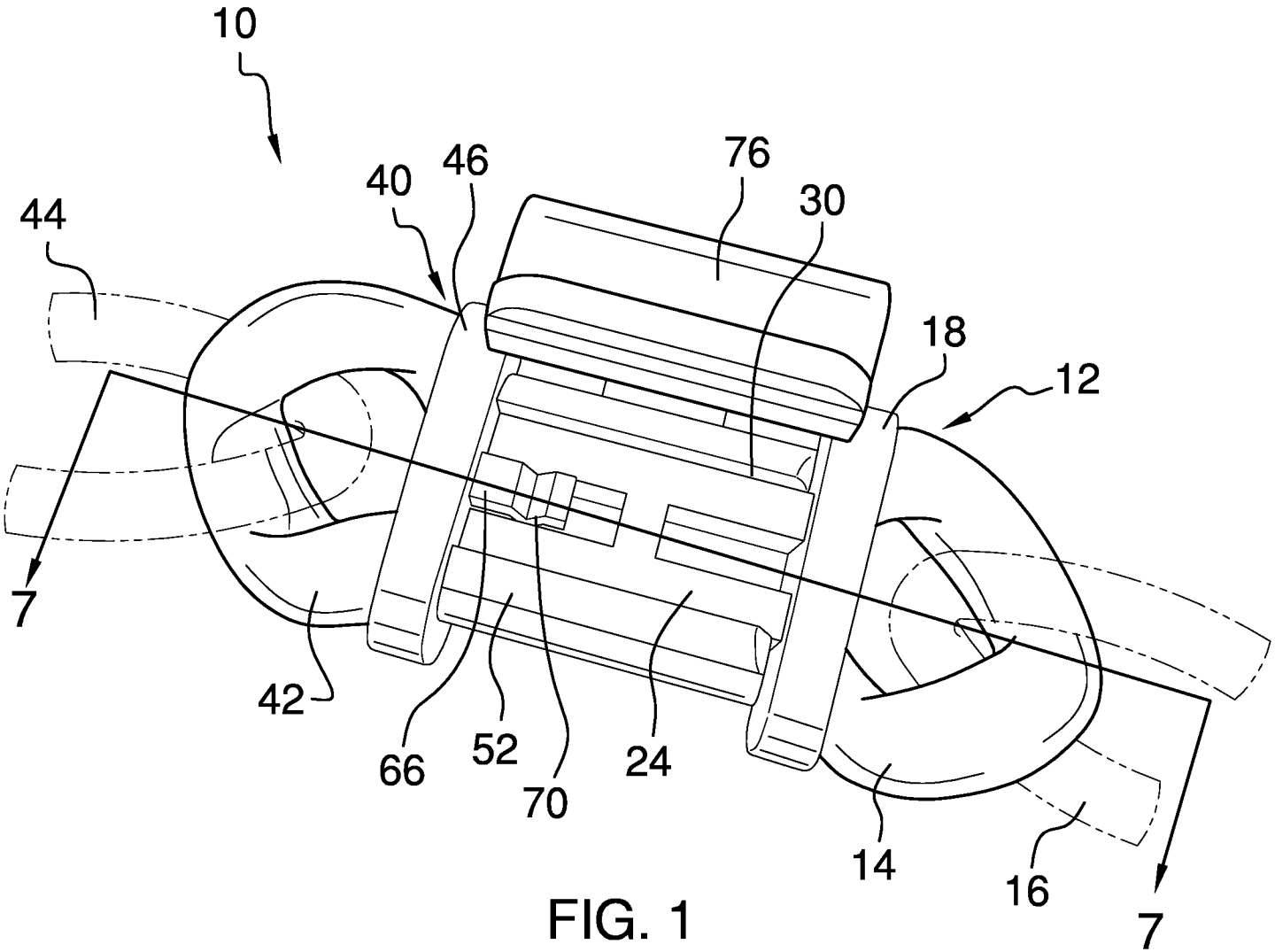
FIG. 1 is a top isometric in-use view of a clasp assembly according to an embodiment of the disclosure.
Figure 2:
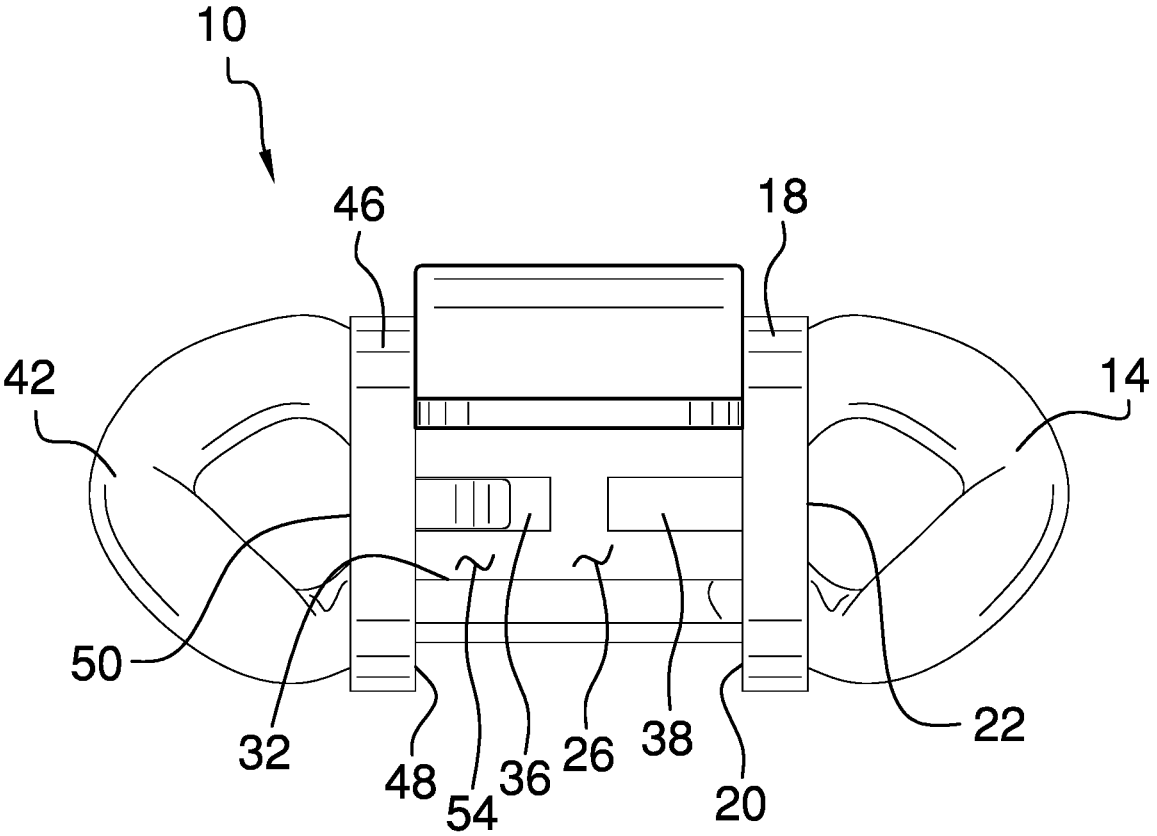
FIG. 2 is a top side view of an embodiment of the disclosure showing the locking clasp in the unlocked position.
Figure 3:
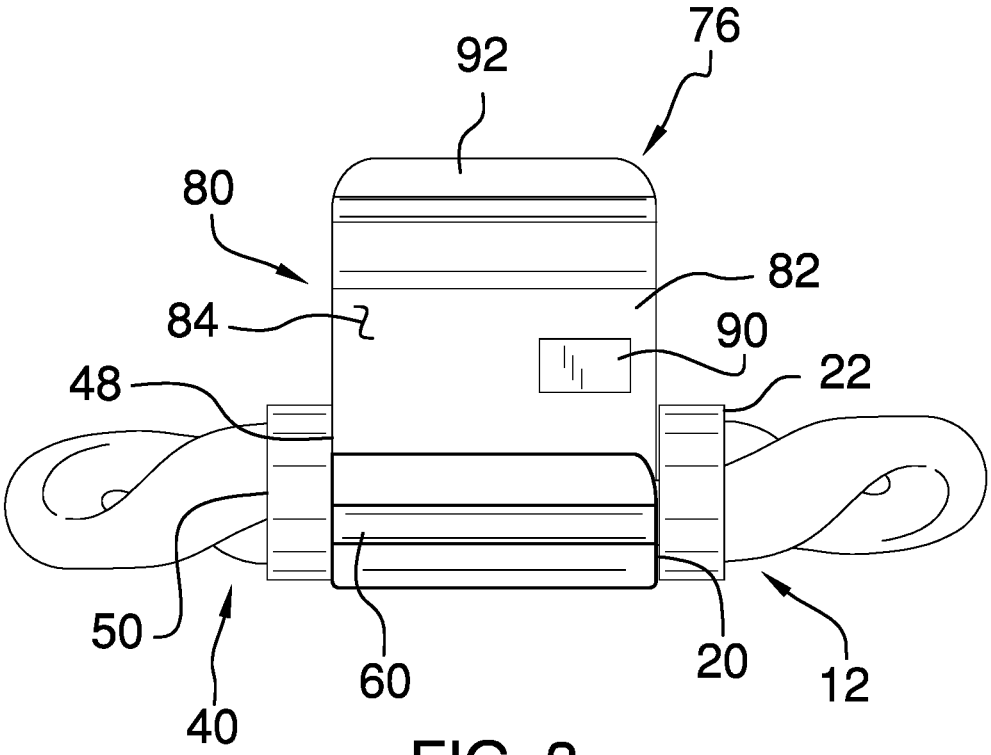
FIG. 3 is a front side view of an embodiment of the disclosure.
Figure 4:
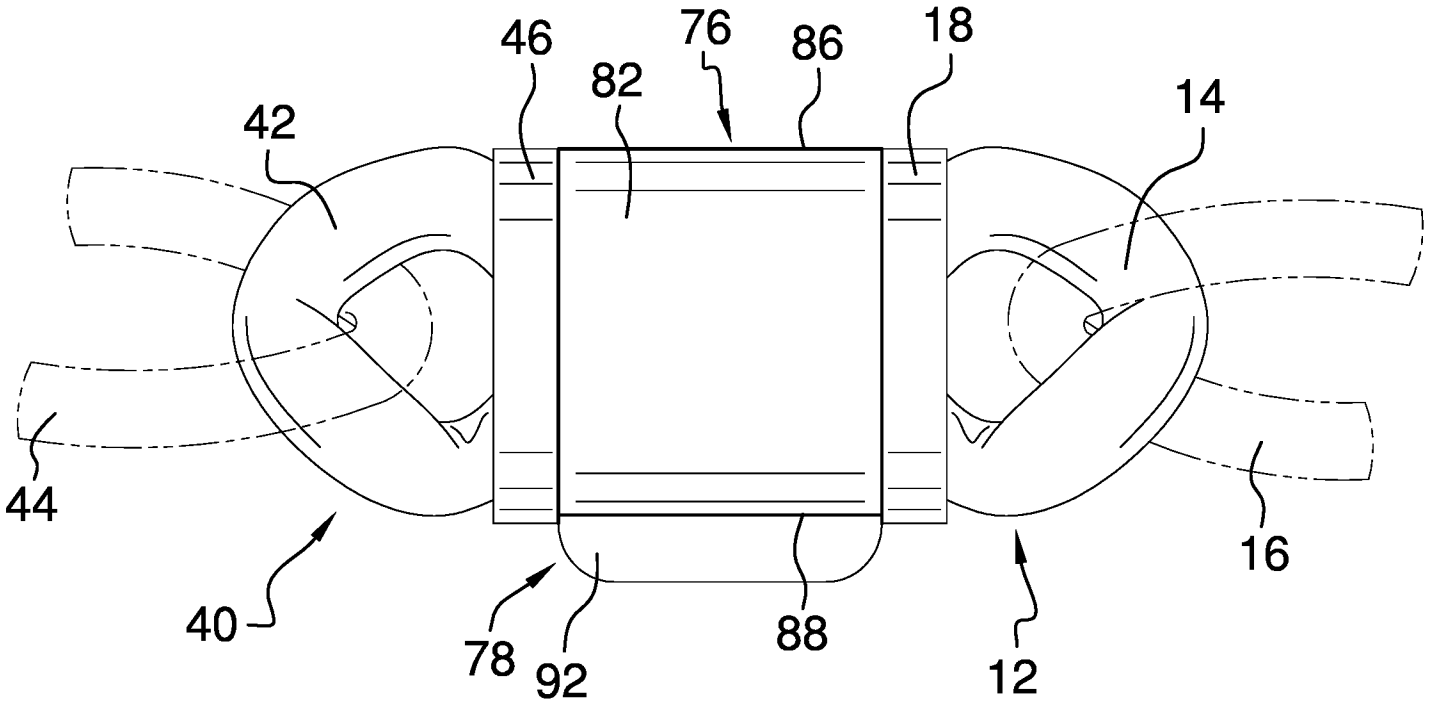
FIG. 4 is a top in-use view of an embodiment of the disclosure showing the locking clasp in the locked position.
Figure 5:
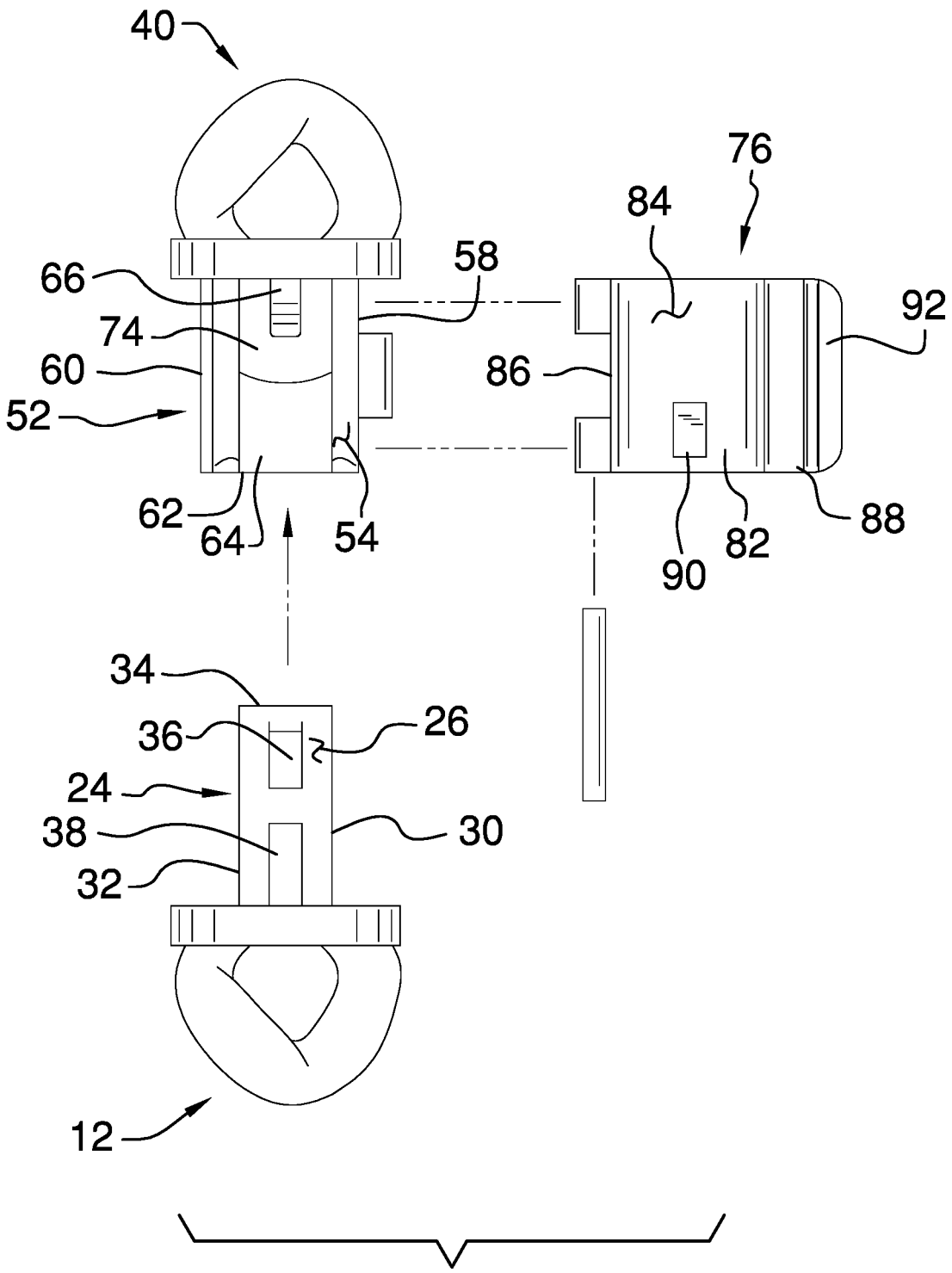
FIG. 5 is an exploded view of an embodiment of the disclosure.
Figure 6:
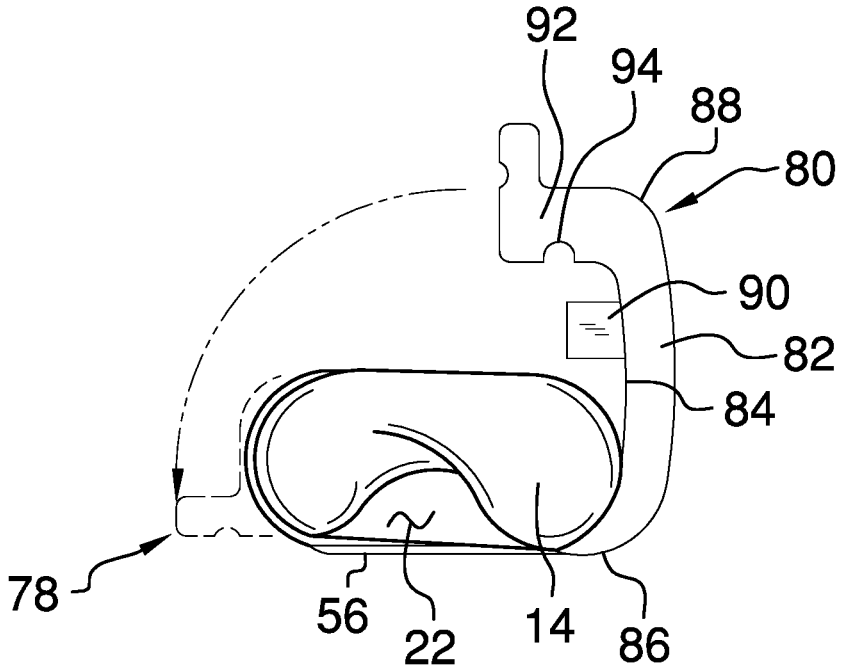
FIG. 6 is a right side view of an embodiment of the disclosure showing the locking clasp movement between the locked position and the unlocked position.
Figure 7:
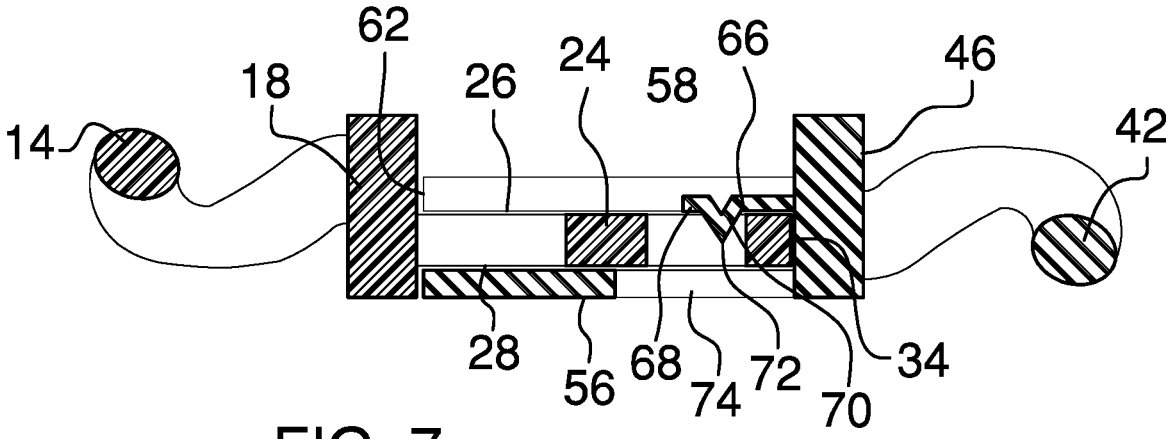
FIG. 7 is a segment view of an embodiment of the disclosure if bisected about line 7-7 from FIG. 1.

With reference now to the drawings, and in particular to FIGS. 1 through 7 thereof, a new jewelry clasp device embodying the principles and concepts of an embodiment of the disclosure and generally designated by the reference numeral 10 will be described.

As best illustrated in FIGS. 1 through 7, the clasp assembly 10 for securing together a pair of free ends of a piece of jewelry, such as, for example, the free ends of a chain or rope used for a necklace, bracelet, anklet and the like. The clasp assembly 10 generally comprises a first mating segment 12. A first loop 14 is attached to and extends outwardly from the first mating segment 12. The first loop 14 is configured to permanently interlock with a first linkage 16 of a piece of jewelry. The first loop 14 will permanently attach to the piece of jewelry to appear a part of the unified whole. The first mating segment 12 includes a first wall 18. The first wall 18 has an interior surface 20 and an exterior surface 22. The first loop 14 is attached to the exterior surface 22. The first loop 14 may be made of the same material as the rest of the piece of jewelry. Suitable materials may include metals, rigid plastics, woven fibrous materials, or other conventional materials. The first wall 18 may be made out of any sufficiently rigid material, including metals, rigid plastics, or other conventional materials found in jewelry manufacture.

A key body 24 is attached to and extends away from the interior surface 20. The key body 24 includes a top face 26, a bottom face 28, a first lateral edge 30 and a second lateral edge 32. The key body 24 has an outer edge 34 positioned opposite of the first wall 18. The key body 24 has a first locking aperture 36 therein extending through the top face 26 and bottom face 28. The first locking aperture 36 is positioned adjacent to the outer edge 34. The key body 24 has a second locking aperture 38 therein extending through the top face 26 and the bottom face 28. The second aperture 38 is positioned adjacent to the first wall 18. The key body 24 may be made of the same materials as the rest of the piece of jewelry, or a more structurally rigid material due to the key body 24 function. Suitable materials may include metals, rigid plastics, or other conventional materials used in jewelry making.

A second mating segment 40 is releasably engaged with the first mating segment 12. A second loop 42 is attached to and extends outwardly from the second mating segment 40, wherein the first loop 14 and second loop 42 extend in opposite directions with respect to each other when the first mating segment 12 and second mating segment 40 are engaged with each other. The second loop 42 is configured to permanently interlock with a second linkage 44 of the piece of jewelry. The second mating segment 40 includes a second wall 46. The second wall 46 has an inner surface 48 and an outer surface 50. The second loop 42 is attached to the outer surface 50. The second loop 42 may be made of the same material as the rest of the piece of jewelry. Suitable materials may include metals, rigid plastics, woven fibrous materials, or other conventional materials. The second wall 46 may be made out of any sufficiently rigid material, including metals, rigid plastics, or other conventional materials found in jewelry manufacture.

A receiver body 52 is attached to and extends away from the inner surface 48. The receiver body 52 includes a top side 54, a bottom side 56, a first side edge 58 and a second side edge 60. The receiver body 52 has a distal edge 62 with respect to the second wall 46. The top side 52 has a key notch 64 which extends downwardly therein and is sized to receive the key body 24. The key notch 64 is spaced from the first side edge 58 and second side edge 60 and extends through the distal edge 62, wherein the key notch 64 has a width equal to a width of the key body 24. The key notch 64 has a height equal to a height of the key body 24. The key notch 64 extends to the second wall 46. The receiver body 52 may be made from any material structurally suitable to restrain and engage with the key body 24. Suitable materials include metals, rigid plastics, or other conventionally available materials found in jewelry manufacture.

A tab 66 is attached to and extends away from the inner surface 48. The tab 66 is configured to resiliently deflect upwardly away from the key body 24 and engage with the first locking aperture 36 of the key body 24 when the key body 24 is placed in the key notch 64. The tab 66 has a lower surface 68. A catch 70 is integrally attached to and extends downwardly from the lower surface 68. The catch 70 is releasably extendable into the first locking aperture 36 to matingly secure the key body 24 in the receiver body 52. The catch 70 has a terminal end 72 and tapers to a point from the lower surface 68 to the terminal end 72. The receiver body 52 has a receiving aperture 74 extending therein and through the top side 54 and bottom side 56. The catch 70 is accessible from the bottom side 56 through the receiving aperture 74. The tab 66 may be made out of any suitably deflectable material, including metals, rigid plastics, or other conventionally available materials found in jewelry manufacture.

A locking clasp 76 is pivotally coupled to the second mating segment 40. The locking clasp 76 is movable between a locked position 78 and an unlocked position 80. The locked position 78 includes the locking clasp 76 extending over and releasably engaging the key body 24 to retain the key body 24 in the receiver body 52. The locking clasp 76 includes a panel 82. The panel 82 has a mating surface 84, an attached edge 86, and a free edge 88. The attached edge 86 is pivotally coupled to the first side edge 58 of the receiver body 52. The mating surface 84 faces the top face 26 of the key body 24 when the locking clasp 79 is in the locked position 78. A detent 90 is attached to the mating surface 84. The detent 90 is positioned to extend through the second locking aperture 38 when the mating surface 84 faces the top face 26 to inhibit the key body 24 from being removed from the receiver body 52. A lip 92 is attached to and extends away from the free edge 88. The lip 92 has an elongated trough 94 therein. The trough 94 releasably receives the second side edge 60 of the receiver body 52 to secure the free edge 88 to the receiver body 52. The locking clasp may be made of any material capable of resisting the forces required to secure the first mating segment 12 and the second mating segment 40 together, including metals, rigid plastics, or other conventionally available materials used in jewelry manufacture.

In use, the locking clasp 76 is put into the unlocked position 80. The key body 24 is inserted into the key notch 64 and moved laterally toward the second mating segment 40 until the tab 66 has engaged the first locking aperture 36. The locking clasp 76 is lowered into the locked position 78 which engages the detent 90 into the second locking aperture 38. The trough 94 engages with the second side edge 60 of the receiver body 52 to secure the locking clasp 76 in place. The first mating segment 12 and second mating segment 40 are secured and locked together.

To detach the first mating segment 12 and the second mating segment 40, the lip 92 of the locking clasp 76 is disengaged with the second side edge 60 and the locking clasp 76 is moved into the unlocked position 80. The first mating segment 12 is moved laterally away from the second mating segment 40 to first disengage the tab 66 from the first locking aperture 36 and finally separate the first mating segment 12 and the second mating segment 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A jewelry clasp assembly configured to attach and lock a first end and a second end of a piece of jewelry, said assembly comprising:

a first mating segment, said first mating segment comprising:

a first wall having an interior surface and an exterior surface;

a key body being attached to and extending away from said interior surface, said key body including a top face and a bottom face;

said key body having a first locking aperture therein extending through said top and bottom faces;

said key body having a second locking aperture therein extending through said top and bottom faces;

a second mating segment being releasably engaged with said first mating segment, said second mating segment comprising:

a second wall having an inner surface and an outer surface;

a receiver body being attached to and extending away from said inner surface, said receiver body including a top side;

said top side having a key notch extending downwardly therein and sized to receive said key body;

a tab being attached to and extending away from said inner surface and being configured to engage with said first locking aperture of said key body when said key body is placed in said key notch;

a locking clasp being pivotally coupled to said second mating segment, said locking clasp being movable between a locked position and an unlocked position, said locked position including said locking clasp extending over and releasably engaging said key body to retain said key body in said receiver body, said locking clasp including:

a panel having a mating surface;

a detent being attached to said mating surface and being positioned to extend through said second locking aperture when said mating surface faces said top face to inhibit said key body from being removed from said receiver body.

2. The jewelry clasp assembly according to claim 1, wherein a first loop is attached to and extends outwardly from said first mating segment, said first loop is attached to said exterior surface.

3. The jewelry clasp assembly according to claim 2, wherein a second loop is attached to and extends outwardly from said second mating segment, wherein said first and second loops extend in opposite directions with respect to each other when said first and second mating segments are engaged with each other, said second loop being attached to said outer surface.

4. The jewelry clasp assembly according to claim 1, wherein said key body includes a first lateral edge and a second lateral edge.

5. The jewelry clasp assembly according to claim 1, wherein said key body has an outer edge positioned opposite of said first wall.

6. The jewelry clasp assembly according to claim 5, wherein said first locking aperture is positioned adjacent to said outer edge.

7. The jewelry clasp assembly according to claim 1, wherein said second locking aperture is positioned adjacent to said first wall.

8. The jewelry clasp assembly according to claim 1, wherein said receiver body further includes a first side edge and a second side edge.

9. The jewelry clasp assembly according to claim 8, wherein said receiver body has a distal edge with respect to said second wall.

10. The jewelry clasp assembly according to claim 9, wherein said key notch is spaced from said first and second side edges and extends through said distal edge.

11. The jewelry clasp assembly according to claim 10, wherein said key notch has a width equal to a width of said key body, said key notch has a height equal to a height of said key body, said key notch extends to said second wall.

12. The jewelry clasp assembly according to claim 8, wherein said panel further includes an attached edge and a free edge, said attached edge being pivotably coupled to said first side edge of said receiver body, said mating surface facing said top face of said key body when said locking clasp is in said locked position.

13. The jewelry clasp assembly according to claim 12, wherein a lip is attached to and extends away from said free edge, said lip has an elongated trough therein, said trough releasably receives said second side edge of said receiver body to secure said free edge to said receiver body.

14. The jewelry clasp assembly according to claim 1, wherein said tab is configured to resiliently deflect upwardly away from said key body and engage with said first locking aperture of said key body when said key body is placed in said key notch, said tab has a lower surface.

15. The jewelry clasp assembly according to claim 14, wherein a catch is integrally attached to and extends downwardly from said lower surface, said catch being releasably extendable into said first locking aperture to matingly secure said key body in said receiver body.

16. The jewelry clasp assembly according to claim 15, wherein said catch has a terminal end, said catch tapering to a point from said lower surface to said terminal end.

17. The jewelry clasp assembly according to claim 15, wherein said receiver body has a receiving aperture extending therein and through a top and bottom sides, said catch being accessible from the bottom side through said receiving aperture.

18. A jewelry clasp assembly configured to attach and lock a first end and a second end of a piece of jewelry, said assembly comprising:

a first mating segment, a first loop being attached to and extending outwardly from said first mating segment, said first mating segment comprising:

a first wall having an interior surface and an exterior surface, said first loop being attached to said exterior surface;

a key body being attached to and extending away from said interior surface, said key body including a top face, a bottom face, a first lateral edge and a second lateral edge, said key body having an outer edge positioned opposite of said first wall;

said key body having a first locking aperture therein extending through said top and bottom faces, said first locking aperture being positioned adjacent to said outer edge;

said key body having a second locking aperture therein extending through said top and said bottom faces, said second locking aperture being positioned adjacent to said first wall;

a second mating segment being releasably engaged with said first mating segment, a second loop being attached to and extending outwardly from said second mating segment, wherein said first and second loops extend in opposite directions with respect to each other when said first and second mating segments are engaged with each other, said second mating segment comprising:

a second wall having an inner surface and an outer surface, said second loop being attached to said outer surface;

a receiver body being attached to and extending away from said inner surface, said receiver body including a top side, a bottom side, a first side edge and a second side edge, said receiver body having a distal edge with respect to said second wall;

said top side having a key notch extending downwardly therein and sized to receive said key body, said key notch being spaced from said first and second side edges and extending through said distal edge, wherein said key notch has a width equal to a width of said key body, said key notch having a height equal to a height of said key body, said key notch extending to said second wall;

a tab being attached to and extending away from said inner surface and being configured to resiliently deflect upwardly away from said key body and engage with said first locking aperture of said key body when said key body is placed in said key notch, said tab having a lower surface;

a catch being integrally attached to and extending downwardly from said lower surface, said catch being releasably extendable into said first locking aperture to matingly secure said key body in said receiver body, said catch having a terminal end, said catch tapering to a point from said lower surface to said terminal end;

said receiver body having a receiving aperture extending therein and through said top and bottom sides, said catch being accessible from the bottom side through said receiving aperture;

a locking clasp being pivotally coupled to said second mating segment, said locking clasp being movable between a locked position and an unlocked position, said locked position including said locking clasp extending over and releasably engaging said key body to retain said key body in said receiver body, said locking clasp including:

a panel having a mating surface, an attached edge, and a free edge, said attached edge being pivotally coupled to said first side edge of said receiver body, said mating surface facing said top face of said key body when said locking clasp is in said locked position;

a detent being attached to said mating surface and being positioned to extend through said second locking aperture when said mating surface faces said top face to inhibit said key body from being removed from said receiver body; and a lip being attached to and extending away from said free edge, said lip having an elongated trough therein, said trough releasably receiving said second side edge of said receiver body to secure said free edge to said receiver body.

* * * * *